US007225816B2

(12) United States Patent
Byers

(10) Patent No.: US 7,225,816 B2
(45) Date of Patent: Jun. 5, 2007

(54) WASTE CONTAINER CLEANING SYSTEM WITH CONVEYOR

(75) Inventor: Ernest F. Byers, Albuquerque, NM (US)

(73) Assignee: Blast-N-Clean, LLC, Albuquerque, NM (US)

( * ) Notice: Subject to any disclaimer, the term of this patent is extended or adjusted under 35 U.S.C. 154(b) by 0 days.

(21) Appl. No.: 11/212,276

(22) Filed: Aug. 25, 2005

(65) Prior Publication Data

US 2006/0042660 A1 Mar. 2, 2006

Related U.S. Application Data

(60) Provisional application No. 60/604,539, filed on Aug. 25, 2004.

(51) Int. Cl.
*B08B 9/093* (2006.01)
*B08B 9/24* (2006.01)

(52) U.S. Cl. ..... 134/22.1; 134/22.18; 134/104.2; 134/166 R

(58) Field of Classification Search ..... 134/22.1, 134/22.18, 62, 104.2, 104.4, 164, 166 R, 134/169 R, 170; 15/56, 71
See application file for complete search history.

(56) References Cited

U.S. PATENT DOCUMENTS 2,951,490 A 9/1960 Cuillier
3,212,511 A 10/1965 Cuillier
3,291,144 A * 12/1966 Diamond ..... 134/104.1
3,324,866 A * 6/1967 Davis ..... 134/52
3,604,038 A 9/1971 Di Ilio
3,881,950 A 5/1975 Pettit
3,901,255 A 8/1975 Pettit
4,242,311 A 12/1980 Middaugh
4,694,846 A 9/1987 Bouchard
5,427,129 A * 6/1995 Young et al. ..... 134/176
5,687,752 A * 11/1997 Boylan ..... 134/115 R
5,964,229 A 10/1999 Brendel
6,284,054 B1 * 9/2001 Galvin ..... 134/10
6,336,239 B1 * 1/2002 Cooper ..... 15/56
6,554,008 B2 4/2003 Dewey et al.

* cited by examiner

*Primary Examiner*—Michael Barr
*Assistant Examiner*—Saeed Chaudhry
(74) *Attorney, Agent, or Firm*—Deborah A. Peacock; Peacock Myers, P.C.

(57) ABSTRACT

The present invention relates to a mobile or stationary waste container cleaning system used for residential, commercial and industrial waste, garbage, trash, storage or operations containers or receptacles. Other applications include, but are not limited to cleaning of chemical drums, grease dumpsters (e.g. behind restaurants), rain barrels and non-uniform residential, commercial or industrial dumpsters or waste containers. The container cleaning system can alternatively be used for rural areas, farms or ranches.

53 Claims, 11 Drawing Sheets

WASTE CONTAINER CLEANING SYSTEM WITH CONVEYOR

CROSS-REFERENCE TO RELATED APPLICATIONS

This application claims priority to and the benefit of the filing of U.S. Provisional Patent Application Ser. No. 60/604,539, entitled "Mobile Waste Can Cleaning System", filed on Aug. 25, 2004, and the specification thereof is incorporated herein by reference.

BACKGROUND OF THE INVENTION

1. Field of the Invention (Technical Field)

The present invention relates to a container cleaning system preferably used for residential and commercial waste, garbage, or trash containers or receptacles.

2. Description of Related Art

Residential and commercial waste containers can collect wastes and pests throughout the course of their use. Cleaning and maintenance of these waste containers can be time consuming and difficult, not to mention dangerous depending on the waste or residue. Often these containers are not cleaned regularly which can lead to worse health and environmental problems, especially in areas of dense populations.

The following is a discussion of the relevant prior and related art. Note that the following discussion refers to a number of publications by author(s) and year of publication, and that due to recent publication dates certain publications are not to be considered as prior art vis-à-vis the present invention. Discussion of such publications herein is given for more complete background and is not to be construed as an admission that such publications are prior art for patentability determination purposes.

U.S. Pat. No. 3,324,866 to Davis, entitled "Sanitation System", issued Jun. 13, 1967, discloses a truck for washing garbage "drums." The device includes a remotely controlled system with a forced fluid and disinfectant cleaning system, a fluid recirculation system and a separation system. This device does not have an arm modified to completely invert a waste container for cleaning.

U.S. Pat. No. 3,291,144 to Diamond, entitled "Trash Bin Washing Apparatus", issued Dec. 13, 1966, discloses a truck for cleaning commercial garbage dumpsters. It includes a fluid recirculation system and a separating system for solid waste removal. This device is a commercial garbage dumpster and does not have a modified arm able to completely invert a waste container, and does not contain a rotating head(s) or rotating nozzles.

U.S. Pat. No. 3,901,255 to Pettit, entitled "Drum Washer for Vehicles", issued Aug. 26, 1975, discloses a cleaning system located on a garbage truck and provides for heated washing of a garbage "drum". There is no mechanism for recirculation of liquid and no modified arm on this device.

Other methodologies have been used to try and solve the environmental, sanitary and health problems, but are time consuming or not cost efficient.

The present invention solves the problems that the prior or related art were unable to solve. The invention includes, but is not limited to: (1) a separate mobile unit (separate from the "garbage" truck) that provides more room for cleaning of the waste containers; (2) a wash fluid separation and recycling system, for better fluid use and efficiency; (3) a loading arm that bends and inverts waste containers up to 180 degrees; and (4) an effective use of time use for washing and convenience.

BRIEF SUMMARY OF THE INVENTION

The present invention relates to a waste container cleaning system to provide a sanitary, efficient and cost effective apparatus and method for preferably cleaning and maintaining residential and commercial garbage containers.

The present invention relates to a method and an apparatus for cleaning waste containers. The waste container cleaning system has at least one fluid spray system and at least one fluid for spraying the waste container. The system includes but is not limited to a loading arm for lifting and inverting the waste container over a spray system and setting it back down; a fluid storage tank for the fluid; and a conveyor system for transporting debris away from the waste container.

The loading arm is bendable up to 180 degrees, and usually more than 150 degrees and preferably, for inverting the waste container over the spray system. The inverted waste container aids in more complete cleaning and reduces residual liquids in the waste container. A knuckle is preferably on the loading arm for grasping and releasing the waste container. The bendable loading arm may be a side loading arm, a front loading arm or a rear loading arm. Inverting the container preferably comprises: grasping the waste container with a knuckle on the loading arm, lifting the container, and inverting the container up to 180 degrees (or at least 150 degrees). The container is spray cleaned and then set back down, reversing the steps of grasping, lifting and inverting.

The loading arm and alternative tipping mechanism may be manual, automated or semi-automated loading arms.

The waste container cleaning system has a fluid spray system which has at least one rotatable coupling, holding at least one spray head. Directional spray nozzle(s) are preferably on the spray head(s) are on the rotatable coupling, and the spray head(s) and spray nozzle(s) may be stationary or rotating. The spray cleaning method includes but is not limited to passing a clean fluid through at least one spray nozzle on at least one spray head on at least one rotatable coupling, and spraying the inverted container with the clean fluid.

The preferred embodiment of the present invention has a fluid recycling system and uses the method of recycling the fluid from the spray system after the inverted waste container has been sprayed.

The waste container cleaning system has a conveyor system which includes but is not limited to a conveyor belt, walking floor, and trumbull system. The conveyor system transports debris and/or waste away from the waste container.

The waste container cleaning system is preferably a mobile system. The mobile system is preferably a separate modified garbage truck. The modified garbage truck is preferably a side loading truck but alternatively may be a front loading truck or a rear loading truck.

A primary object of the present invention is to provide a sanitary and efficient system for cleaning and maintaining waste containers.

Primary advantages of the present invention are a loading arm that can dump to 180 degrees, a rotating coupling within the system for maximum spray nozzle output, and a cleaning cycle system that is efficient, cost effective and can be used during regularly scheduled garbage routes.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
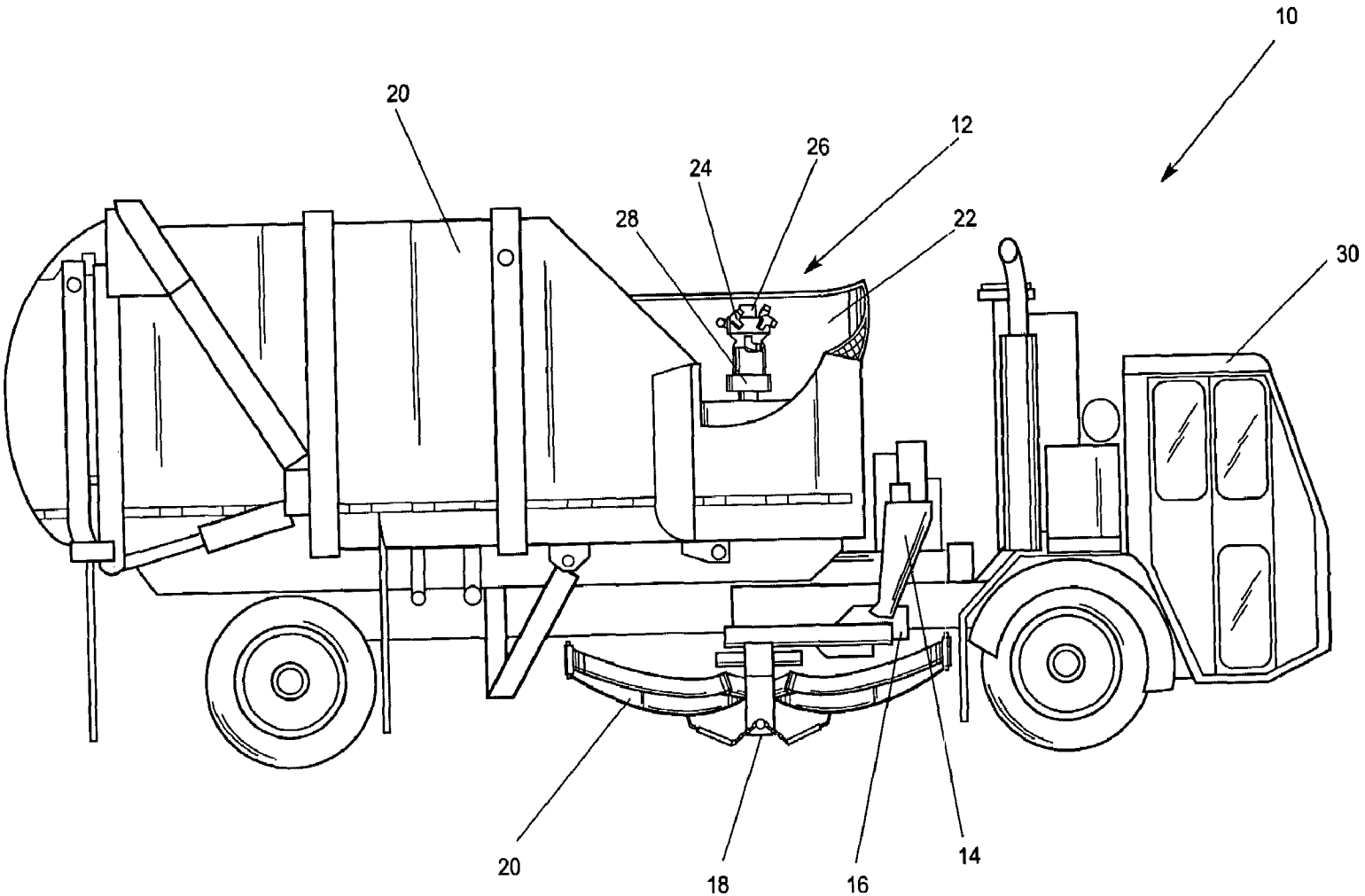
FIG. 1 is a side view of the preferred embodiment of the invention on a modified garbage truck.

The present invention is a method and apparatus for waste container cleaning which is preferably used to clean residential (e.g. 35 gallons to 350 gallons) or commercial or industrial (e.g. 1 cubic yard to 10 cubic yards) garbage containers. The cleaning system preferably comprises a mobile system, including but not limited to a truck or vehicle separate from the regularly scheduled garbage truck. The preferred embodiment of the invention is a side loading vehicle with a side loading arm that has been modified to invert a waste container 180 degrees. Alternatively, the waste container is inverted to less than 180 degrees, but preferably more than 150 degrees. The cleaning cycle is preferably several seconds (between approximately 6 seconds and approximately 15 seconds) so that the vehicle is able to follow a garbage truck along a regularly scheduled route and clean the waste containers after being dumped by the garbage truck.

As used throughout the specification and claims the term "waste containers" or "garbage containers" is intended to include any residential, commercial or industrial apparatus or device which is capable of containing waste materials or debris, and includes but is not limited to a trash receptacle, trash container, industrial container, garbage can, and dumpster. As used throughout the specification the term "pests" is intended to include any materials or organisms that may corrupt the container, including but not limited to fungi, bacteria, and odors.

The invention preferably comprises a series of different, automated, interactive systems, including but not limited to a lifting and inverting system, a spray cleaning system, a conveyor system, a fluid providing and/or recycling system and debris collection system.

The lifting and inverting system preferably comprises an arm and knuckle.

The spray cleaning system preferably comprises spray nozzles on spray head(s) on rotatable coupling(s) connected to a clean fluid pipe, connected to a clean fluid storage tank and associated pumps and piping. A bottom layer of nozzles (preferably between one and two nozzles) is preferably directed in one position, and sprays the clean fluid. A middle layer of nozzles preferably has four directionally positioned nozzles and sprays a degreaser. The top layer of nozzles (preferably five nozzles) is placed in directional positions and sprays a detergent (see FIG. 2). As used throughout the specification and claims the term "detergent" means a soap or cleaning substance and also may comprise any antibacterial, antiviral, and/or sanitary agent. Cleaning fluids may be pre-mixed, combined in a tank or divided into separate layers including but not limited to a top, middle and bottom level. The conveyor system is a conveying device that transports the debris away from the inverted container during cleaning. It preferably includes a brush to clean the conveying device. The fluid recycling system includes but is not limited to a catch basin for catching fluid used during the spray cleaning; a filtering and separating mechanisms to separate cleaned or recyclable fluids from final waste fluids; mechanisms for reintroducing the cleaned fluid back into the clean fluid storage tank; and associated piping and pumping devices.

Figure 3:
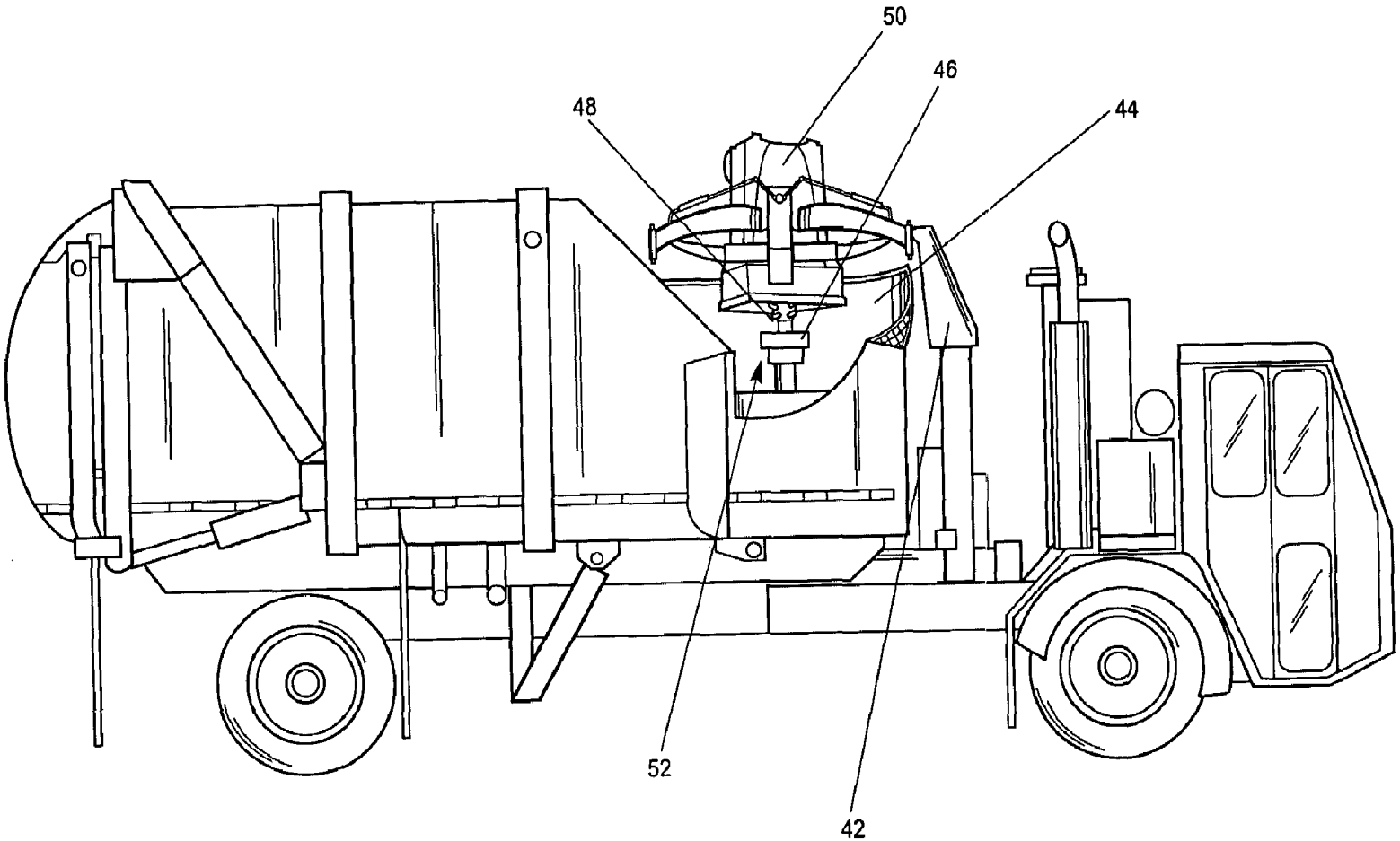
FIG. 3 is a side view of an inverted waste container over the waste container cleaning system of the FIG. 1 embodiment.
Figure 4:
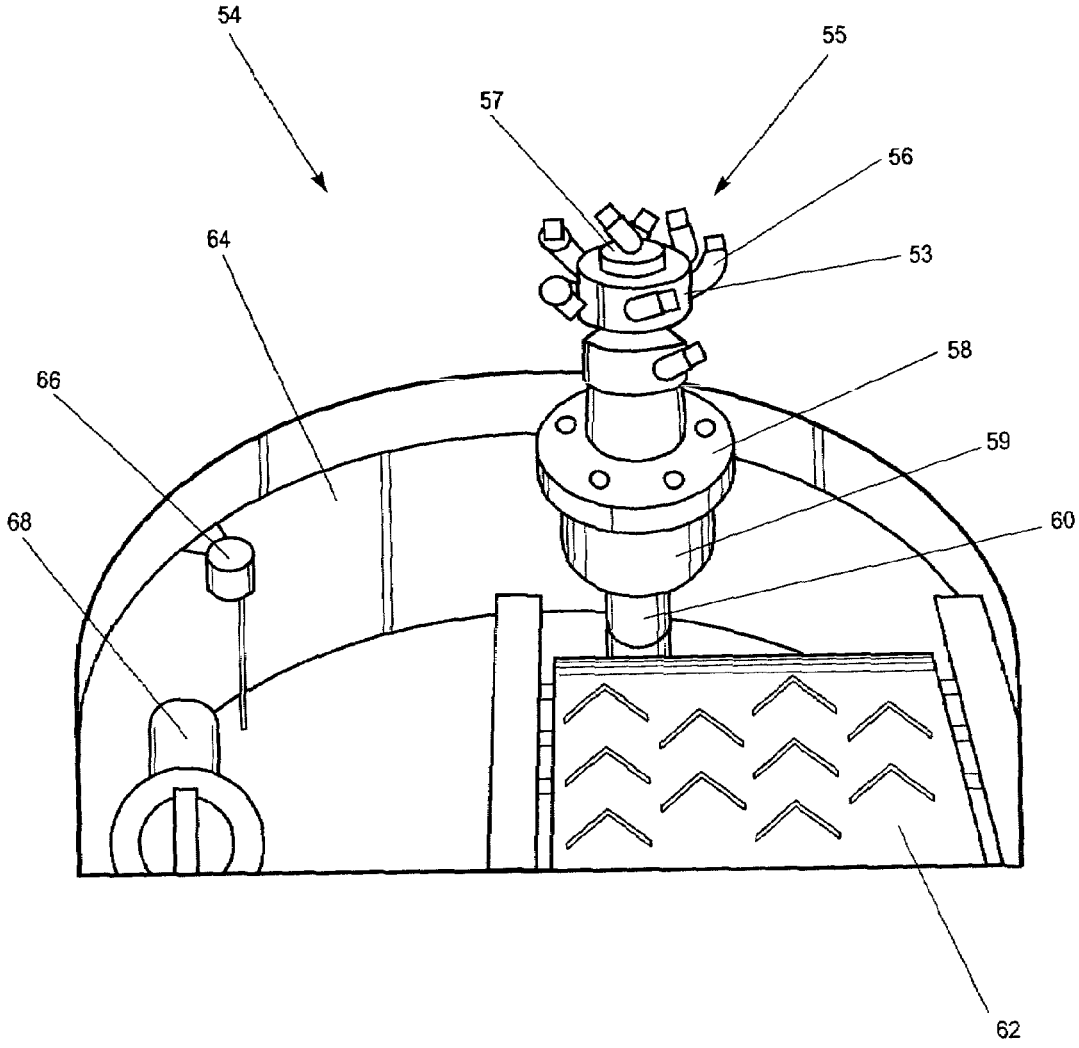
FIG. 4 is a top perspective view of the preferred embodiment of the spray cleaning system of the FIG. 1 embodiment.
Figure 5:
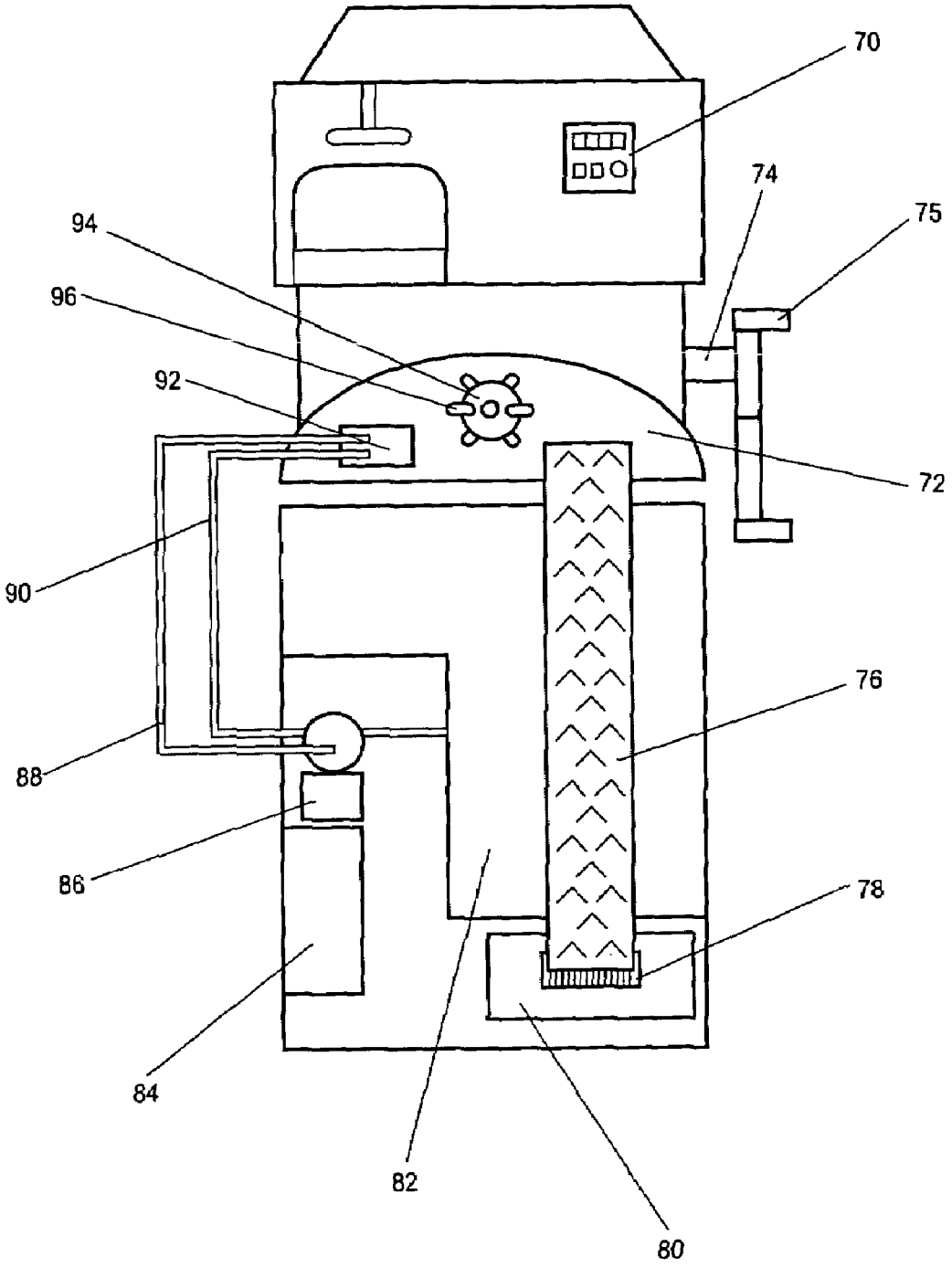
FIG. 5 is a top view schematic of the preferred embodiment of the invention.
Figure 8:
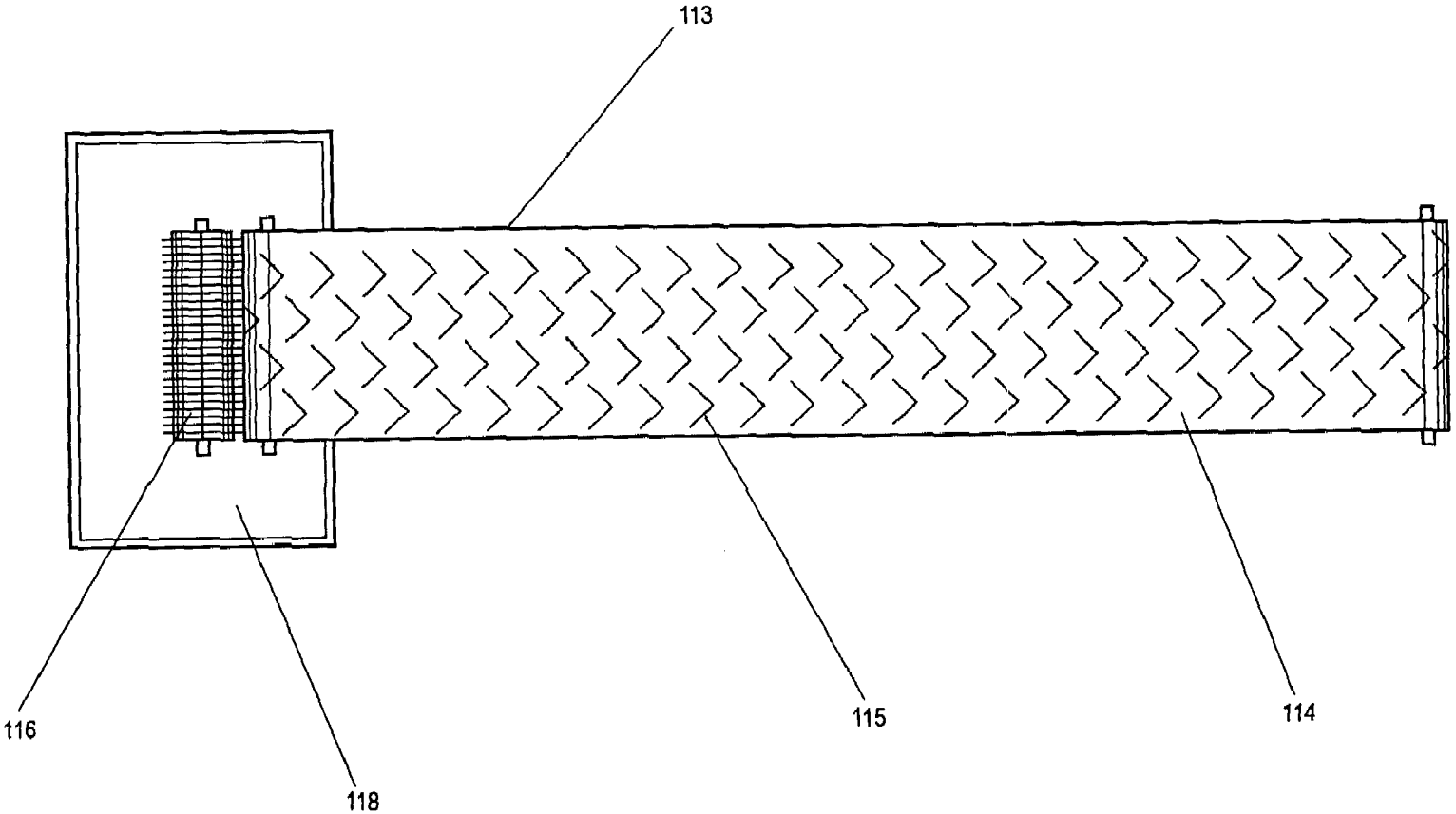
FIG. 8 is a top view of a conveyor system of the present invention with a cleaning brush and residue basin.
Figure 9:
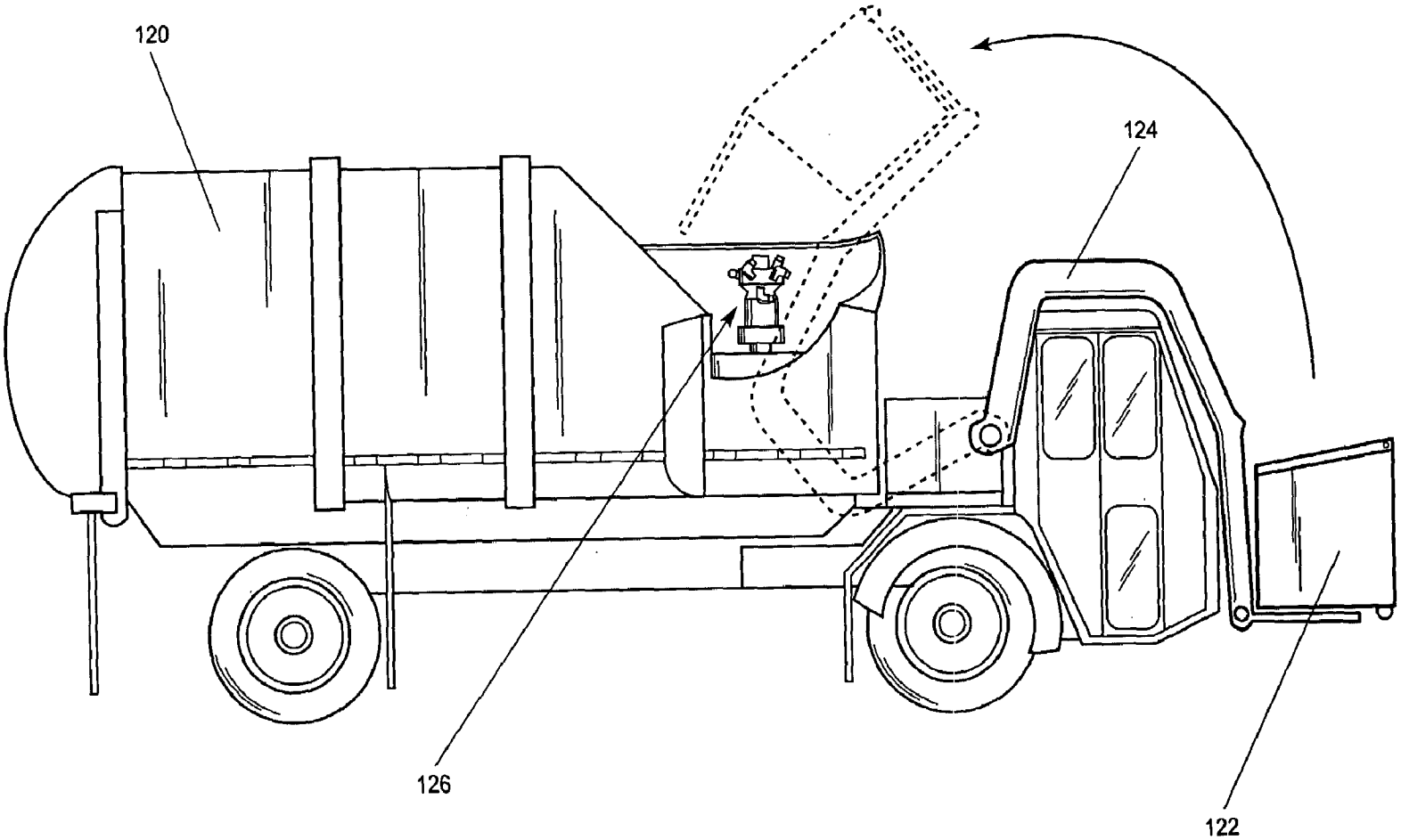
FIG. 9 is a side view of an alternative front loading embodiment of the invention.
Figure 10:
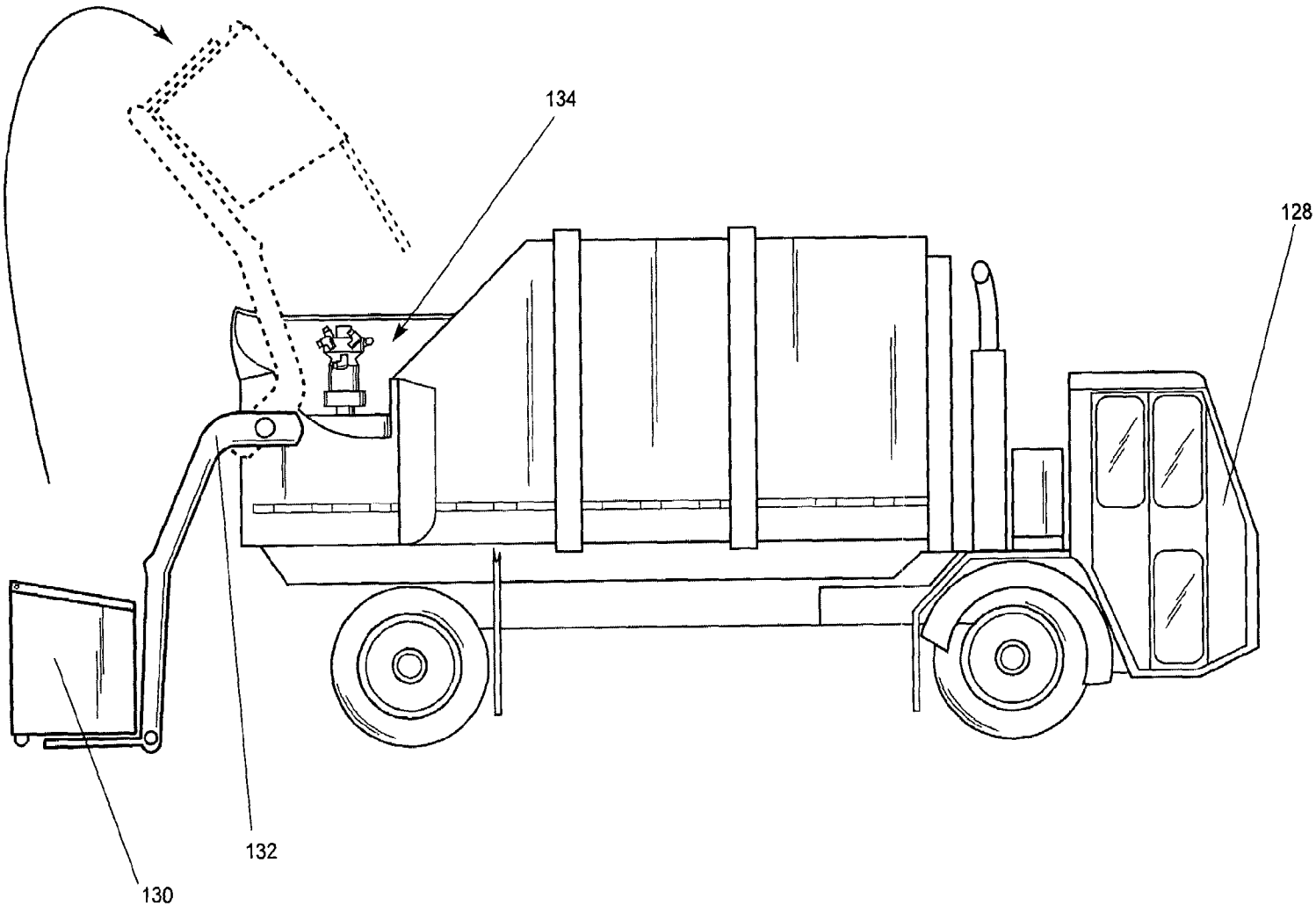
FIG. 10 is a side view of an alternative rear loading embodiment of the present invention.
Figure 11:
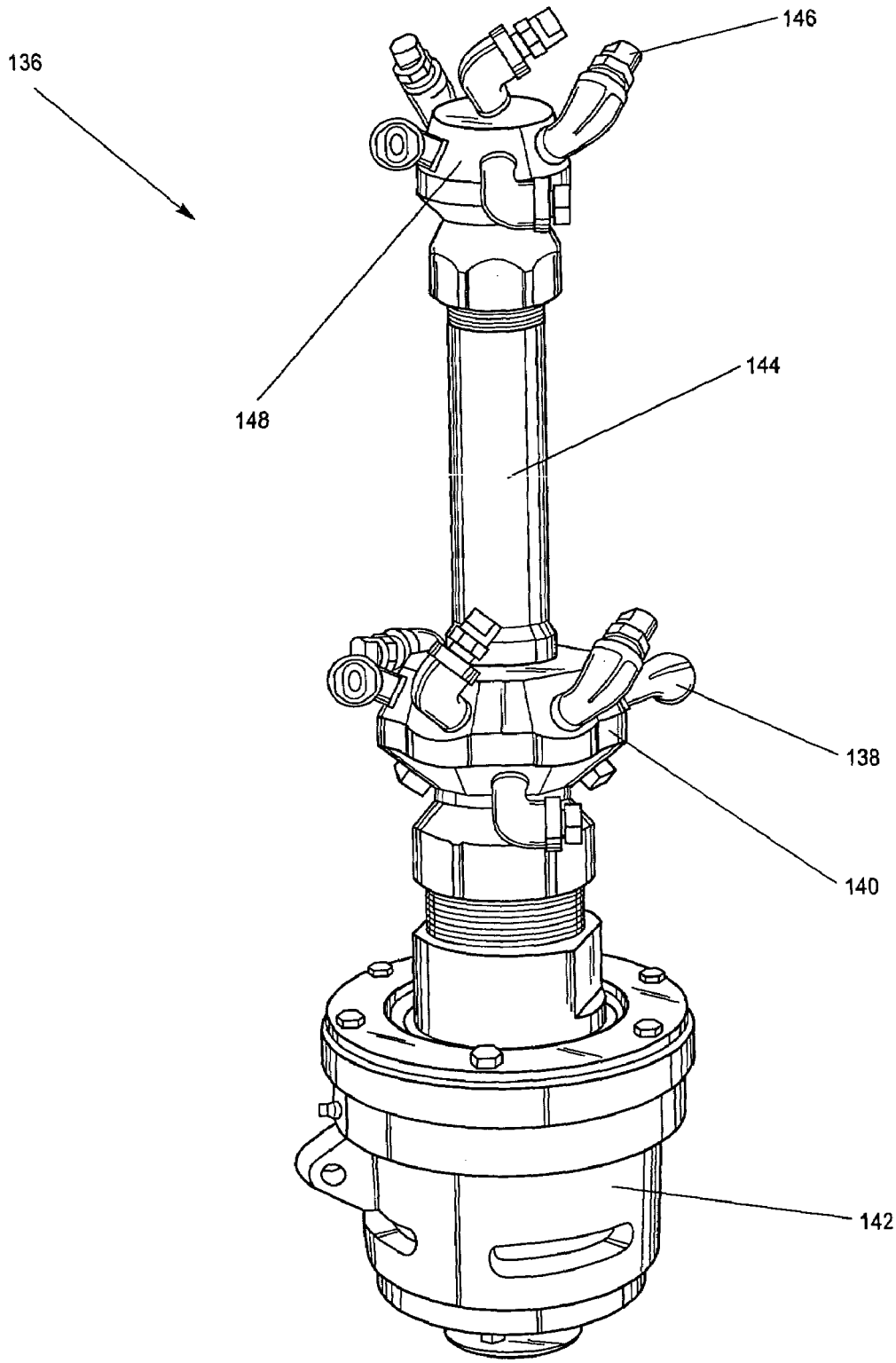
FIG. 11 is a side perspective view of an alternative two-headed nozzle and spray head embodiment of the present invention.

The drawings show the preferred and alternative embodiments of the invention. FIGS. 1 through 8 show the preferred embodiment of the invention, and FIGS. 9–11 show alternative embodiments of the invention. FIG. 1 gives a general overview of the invention, FIGS. 2 through 4 focus on the spray cleaning system, FIGS. 5 and 8 is a schematic view where the interaction of the different systems and the recycling systems, associated piping and pumping devices will be discussed.

FIG. 1 is a side view of the preferred embodiment of the invention. As shown therein, vehicle 10 is preferably a modified garbage truck where containment shell 20 has been "hollowed" and modified to fit in the system components. A portion of containment shell 20 has been cut away 12 in the area of the front of the truck, behind the cab, which preferably houses the front portion of the cleaning system. Preferably a driver in cab 30 sees a waste container on a curb and pulls up next to the curb. The driver preferably operates arm 14, 16 and knuckle 18, 20 remotely through a system control box inside of cab 30. Once extended the driver uses arm 14, 16 and knuckle 18, 20 to grab, lift and invert the waste container over the front portion of the cleaning system. The inverted container is spray cleaned with a fluid and then the operator sets down the waste container using arm 14, 16 and knuckle 18, 20.

As used throughout the specification and claims the term "fluid" is intended to include any fluid material, including but not limited to a solid, semi-solid, powder, liquid or vapor. A fluid also includes but is not limited to cold fluid, hot fluid, steam, chemicals, liquids, solids, semi-solids, gases, chemicals, oils, granules and sprays.

Figure 2:
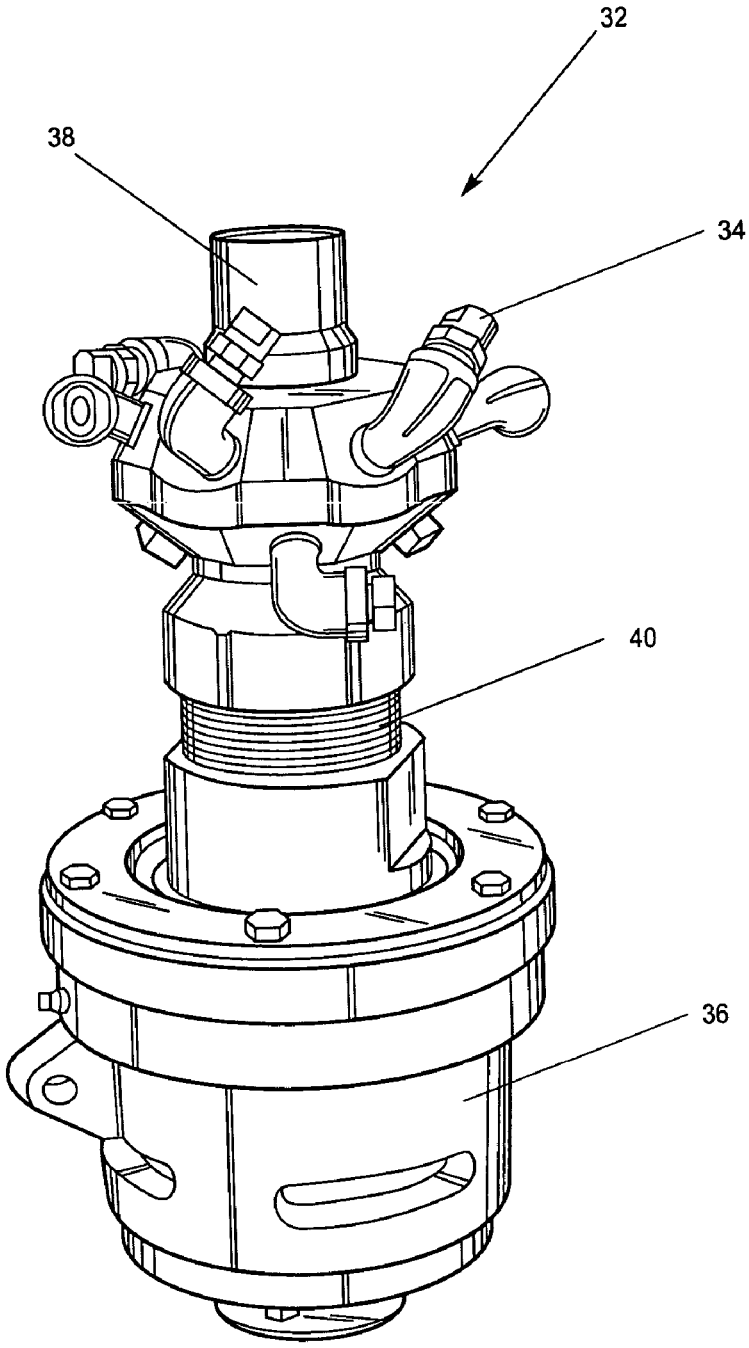
FIG. 2 is a side perspective view of a spray head with spray nozzles on a rotatable coupling of the FIG. 1 embodiment.

FIG. 1 also shows a spray cleaning system of the invention which includes but is not limited to catch basin 22, and directional spray nozzles 24 disposed on spray head 26 which is disposed on rotatable coupling 28. FIGS. 2 through 4 show a more detailed view of the spray cleaning system.

FIGS. 2 and 4 show close up views of the preferred embodiment of the spray portion of the spray cleaning system, and FIG. 3 shows an inverted waste container over the spray cleaning system. Spray system 32 preferably includes rotating coupling 36. Coupling is preferably made of metal(s) including but not limited to brass and stainless steel, or other heavy duty materials, with internal seals and bearings. Spray head 38 and directional nozzles 34 rest on top of rotating coupling 36. Spray head 38 and nozzle 34 are preferably made of metal or often heavy duty material(s). Spray head 38 and directional nozzles 34 spin preferably between approximately 3 rpm and approximately 2000 rpm. The fluid is delivered at a flow rate of preferably between approximately 25 gal/min and approximately 500 gal/min to nozzles 34 through piping 40, and each nozzle 34 pressure sprays the garbage container (preferably between approximately 5 gal/min and approximately 50 gal/min).

FIG. 3 shows container 50 inverted over container cleaning system 52. Container 50 is held over container cleaning system 52, and is preferably spray cleaned. When catch basin 44 (e.g. 50 gallons to 500 gallons) fills with fluid, a fluid level sensor (see FIG. 4) preferably activates the suction and the waste fluid is removed, filtered, strained and recycled. Once cleaned, the waste container is preferably returned to the curb via arm 42. FIG. 3 depicts a typical residential waste container 50. The preferred embodiment of the invention can be used for either residential, commercial or industrial waste containers.

FIG. 4 shows a top perspective view of container cleaning system 54. Spray nozzles 56 are configured to hit the top corners or perimeter, middle and bottom of the inside of a waste container. The preferred embodiment uses at least one spray head 55 with nozzles 56. The spray preferably has a tornado effect and is preferably designed to allow the maximum cleaning and sanitizing. Cleaning fluids may be pre-mixed, combined in a tank or divided into separate layers including but not limited to a top, middle and bottom level. Top spray nozzle layer 57 is preferably a detergent layer which contains antibacterial and antifungal components to ensure a sanitary cleansing. Other chemicals are preferably added to address different sanitary issues including, but not limited to, disinfection, deodorization, anti-odor, insects and pests. These chemicals are preferably biodegradable and environmentally friendly. Middle spray nozzle layer 53 preferably sprays a degreasing agent. Bottom spray nozzle layer 59 is preferably a water layer. The cleaning cycle is preferably sequenced (e.g. degreasing, soap and rinse) to ensure thorough cleaning. Different pipes or lines 60 are preferably attached to spray nozzle layers 53, 57, 59, and the waste fluid all goes to catch basin 64. Fluid level sensor 66 detects the level of waste fluid and triggers the recycling system 68 once the catch basin is adequately filled. FIG. 4 also shows conveyor 62, discussed in more detail below.

The fluid is preferably recycled and reused in the cleaning system. At the end of the day or run, the recycled fluid is preferably filtered and may be dumped down a sewer system and any residue or waste may be dumped at the end of the day. The filter is preferably a screen filter, and the preferred embodiment includes but is not limited to intake and effluent valves that are used to intake fluid into the clean storage basin and remove the waste fluids and a system exhaust vent.

FIG. 5 is a top view schematic diagram of the waste container cleaning system, which provides an overview of the preferred embodiment of the container cleaning system. The waste container cleaning system, preferably includes (from front to back) catch basin 72, spray head 94, directional nozzles 96 on a rotating coupling, filter area and fluid level sensor 92, suction waste fluid removal piping 88, clean fluid intake piping 90, pump 86, engine 84, clean fluid storage tank 82, conveyor 76, conveyor brush 78 and residue bin 80. The driver then preferably uses control box 70 to activate pump 86. FIG. 5 also shows arm 74 and knuckle 75. Pump 86 is preferably idling until the driver activates it. Once activated, preferably through switching box 70, the fluid, preferably clean or grey fluid, is preferably pumped from clean fluid storage tank 82 through the gate valve. Clean fluid storage tank 82 preferably has a capacity of between approximately 500 gallons and approximately 2000 gallons. As the container is inverted (most preferably approximately 180 degrees, but at least more than 150 degrees) it is positioned over spray nozzles 96 (see FIG. 3) which clean, rinse and sanitize the garbage container.

The container cleaning system preferably employs electric shut off valves and pressure relief valves, and self contained auxiliary engine 84. Auxiliary engine 84 and pump 86 preferably bring in the fluid from the storage tank 82 and disperses the clean fluid through spray nozzles 96. Pump 86, suction 88 and conveyor 76 are preferably left on during the entire scheduled run, and are either activated by the driver, preferably using solenoids or other control mechanisms, or are alternatively automatically activated through sensors. Auxiliary engine 84 (preferably between approximately 25 hp and approximately 500 hp) drives the system and pump 86 (preferably between approximately 25 gal/min and 500 gal/min). Suction system 88 (e.g. ½" to 6" pipe) removes the fluid. Engine 85 may be diesel, gas or an electric engine as appropriate to the cleaning application. Additionally, pneumatic, electric or mechanical pumps may be used as appropriate to the cleaning operation.

Piping 88, 90 and storage tanks 82, 80 are preferably made of metal or other heavy duty materials, suitable to their purpose. Any particulate or large matter waste preferably falls onto conveyor 76 (see FIG. 8) and is moved to the back of the cleaning system and into residue bin 80 including but not limited to a bin that can hold between approximately 1 yd and 5 yds.

Figure 6:
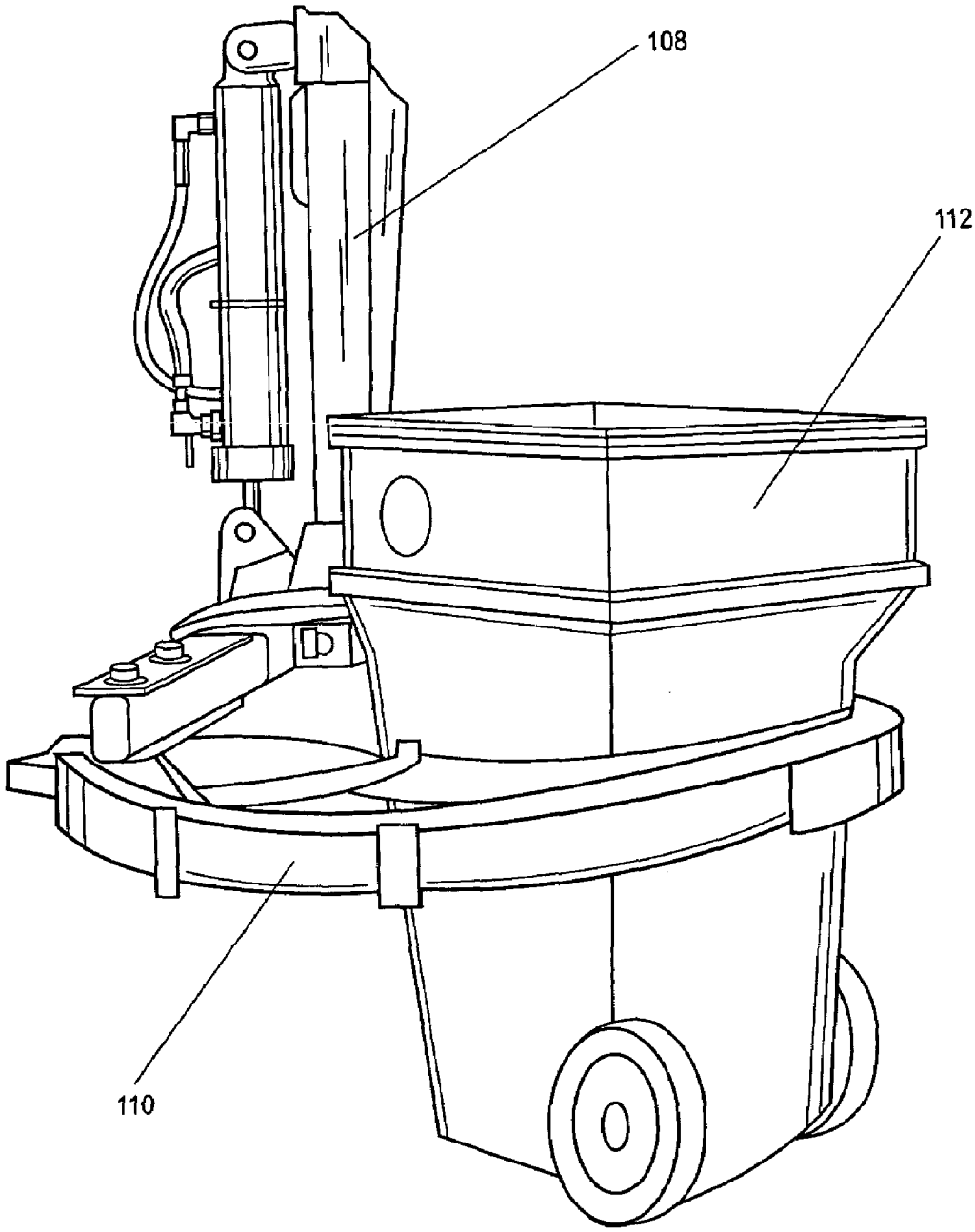
FIG. 6 is a side perspective view of a loading arm, knuckle and waste container of the FIG. 1 embodiment.
Figure 7:
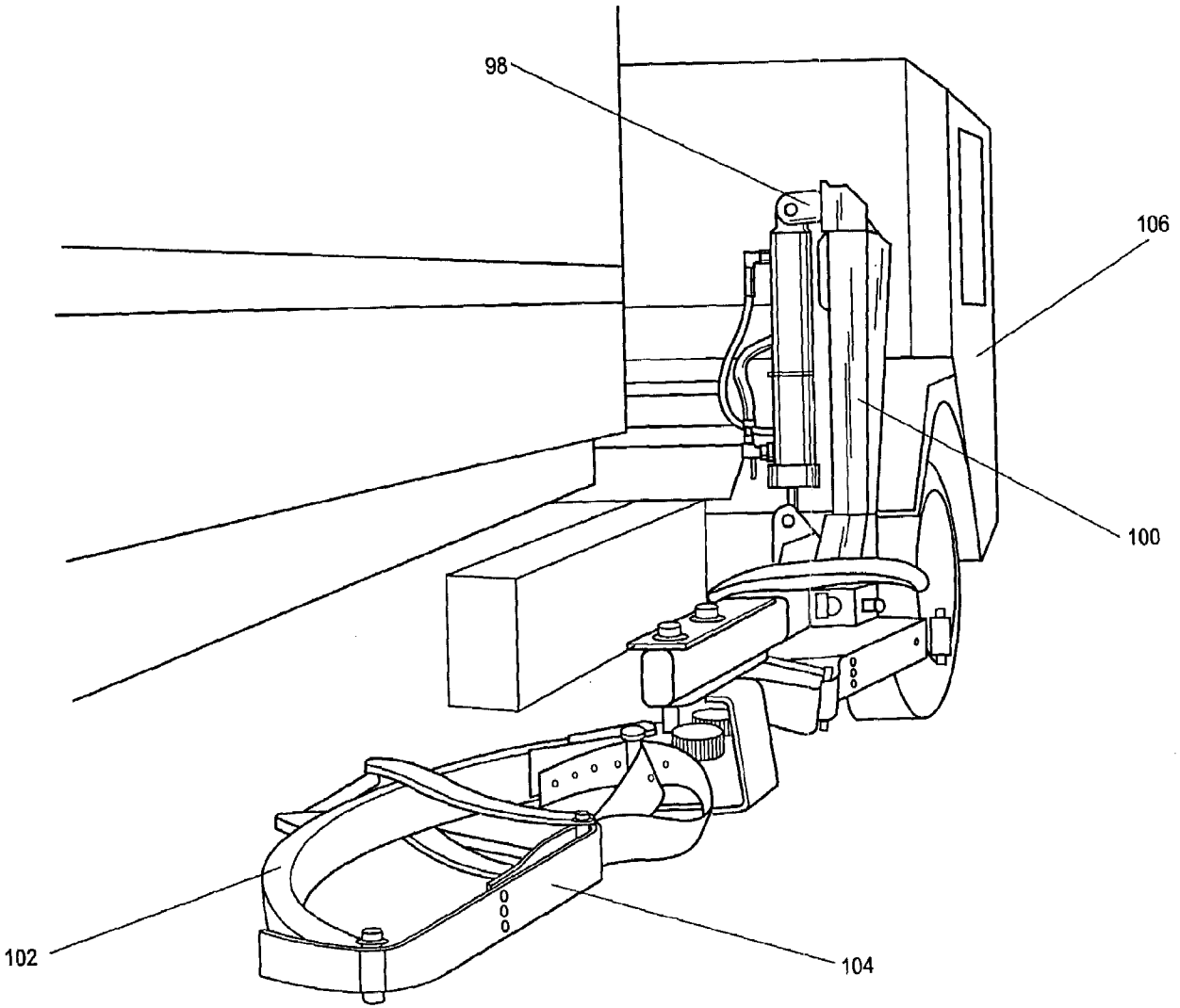
FIG. 7 is a rear perspective view of the loading arm of the FIG. 1 embodiment.

FIGS. 6 and 7 show the preferred embodiment of arm 108 and knuckle 110 which allow for a 180 degree inversion of waste container 112 relative to its upright position while seated on the ground or other platform. In other words the 180 degree inversion means the waste container is held upside down. Alternatively, the inversion may be at a lesser angle but preferably greater than 150 degrees. FIG. 7 shows arm 98 is preferably lengthened and with the joint moved. FIG. 7 shows arm 100 connected directly behind cab of truck 106 on the front portion of truck. Knuckle 102 disposed on arm 100, allows for the waste container to be clasped, and is preferably modified to be universal. Straps or belts 104 may be used to assist in stabilizing or securing the waste container.

FIG. 8 depicts conveyor 114 which preferably uses catch basin (see FIG. 4, 64) to "catch" the large debris from the inverted waste container, before and after spray cleaning. Conveyor 114 preferably has guide rail 113 and v-notches 115 on the tread of conveyor to contain debris on conveyor during transport to residue bin 118. Conveyor 114 is preferably made of rubber or other suitable material(s), but may also include a stepping floor or a trumbull device. Brush 116 is preferably used in conjunction with conveyor 114 to help clean and remove the waste matter from conveyor 114. Conveyor 114 is preferably slanted over catch basin (see FIG. 4, 64) and residue bin 118, to provide a gravity pull for the excess fluid and the waste/residue to fall into catch basin and waste/residue bin 118 respectively. Alternatively, any type of conveyor material or conveyor, or even a shifting floor mechanism may be used as the conveyor.

FIGS. 9 and 10 show alternative embodiments of the present invention. FIG. 9 shows front loading truck 120 with front loading arm 124 loading commercial type waste container 122 over spray cleaning system 126. FIG. 10 shows rear loading truck 128 with rear loading arm 132 loading commercial type waste container 130 over spray cleaning system 134. Alternatively, the back of the truck may be enclosed and other types of arms or lifting systems may be employed.

The preferred embodiment of the present invention, shown in FIGS. 1–8, employs a spray system with one spray head 140. FIG. 11 shows an alternative embodiment of spray system 136 with two spray heads 140, 148, and connector 144. Bottom spray head 140 has top nozzle 138 removed, and piping provides a connector 144 to top spray head 148. Top spray head 148 has directional spray nozzles 146. Rotating coupling 142 drives the entire spray head system. Other alternative embodiments have vertical piping and single or multiple spray heads for greater surface area coverage.

The preferred embodiment is a cold water spray system. Alternative embodiments include hot water or steam systems, and mist systems that can recapture the mist for reuse. Other alternatives use solvents, chemical agents, and/or granule spray cleaning similar to sandblasting or shot peening. Additional alternatives may include a cleaning brush, wiping mechanism, and other types of spray systems. A stationary coupling may be used as an alternative to the preferred rotatable coupling.

The preferred embodiment is an automated loading arm. Alternative embodiments include any manual, semi-automatic, and automated lifting and tipping mechanisms. Other alternatives are cylindrical, chain, and frame rail lifting mechanisms. Alternative embodiments to the preferred knuckle include bushings, joints, ball-bearing mechanisms, cylinders, chains, cables, hydraulics, electrical and air mechanisms.

Separate tanks may also alternatively be used to hold any of the cleaning agents, clean fluid, and waste fluid. In alternative embodiments, filters appropriate to the cleaning needs may be used.

The container cleaning system is preferably mobile. Alternatively the cleaning system may be part of the garbage truck (e.g. a separate trailer) or a single person mobile unit. A number of alternative embodiments are available with slight modifications to the system. The cleaning system may alternatively be employed as a stationary cleaning system at, for example, a transfer station, landfill, toxic or hazardous waste sites or active storage units, and at remediation sites.

Other alternative embodiments include, but are not limited to, chemical drums, grease dumpsters (e.g. behind restaurants), rain barrels and non-uniform residential, commercial or industrial dumpsters or waste containers. The container cleaning system can alternatively be used for rural areas, farms or ranches.

INDUSTRIAL APPLICABILITY

The invention is further illustrated by the following non-limiting example.

EXAMPLE

A waste container cleaning system was constructed in a modified garbage truck. The garbage truck was modified by hollowing out the truck. A Heil 5000 arm was modified through a series of steps (see FIGS. 6 and 7): cutting and modifying the hopper, the cylinder was removed, the base end cylinder mounting were cut, the base end cylinder mounting bracket was moved 7" higher than originally set, and the cylinders were changed from 13" to 21". The knuckle bearing was made universal by changing the pivot points. The arm was modified to allow for a 180 degree inversion of a waste container. The system that was constructed cleaned residential (100 gallon) or commercial (300 gallon) waste containers. The arm was a side loading mechanism.

A half-circle, 350 gallon catch basin, 36" wide×36" high× 36" length, was made out of steel, and an 1100 gallon, L-shaped steel storage tank was used for the clean fluid storage. A high level float or fluid sensor was placed in the catch basin to activate the removal suction.

The approximate cleaning time from grasping the waste container to replacing the waste container was 8–12 seconds. From grasping the container to inversion took approximately 2 to 3 seconds. Cleaning took approximately 4 to 6 seconds. Replacing the container took approximately 2 to 3 seconds.

Once the driver activated the pump, it went from an idling (on) position to a slow increase in power. The pump pulled the fluid from the clean fluid storage tank through a PACO end suction, frame mounted, centrifugal, diesel driven pump (200 gallons per minute). The fluid reached the pump after passing through a swing style bronze check valve. The fluid exited the pump and was controlled by a Bermad "gate" valve. The gate valve was controlled by an electric solenoid that was activated by the driver. To protect the system, a pressure relief valve was included which turns the system off when high pressures were reached and allows the fluid to flow safely back into the storage tank.

The cleaning mechanism was a brass and steel rotating coupling with stainless steel directional nozzles located inside the catch basin. The spray nozzles spun (1200 rpm) and the fluids were delivered to the nozzles at approximately 30 gallons per minute. The bottom layer of nozzles was directed in one position, and sprayed the clean fluid. The middle layer had four directional positioned nozzles and sprayed degreaser. The top layer of five nozzles was placed in five directional positions and sprayed a detergent which also contained antibacterial and sanitizing agents. The layers sprayed in alternate sequencing, with degreaser first, next the soap and finally the clean fluid rinse. Some of the waste containers were dry when replaced.

The conveyor belt was a 10' rubber conveyor with v-notches and wooden guide rails to prevent the waste material from falling off of the side of the conveyor. The conveyer had an approximately 22 degree slope. The engine was a 230 hp diesel engine.

Once the high fluid sensor detected a high level of fluid in the catch basin, the suction pump automatically turned on. The fluid passed through a screen filter, which was designed to be easily maintained, and passed through a smaller screen filter, and then through the piping to the storage tank, and was ready to be reused. The suction through the pipe was at 200 gallons per minute. The waste container was then replaced to its upright position.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above and/or in the attachments, and of the corresponding application(s), are hereby incorporated by reference.

What is claimed is:

1. A mobile waste container cleaning system for large waste containers comprising:

a transportable base comprising thereon;

at least one fluid spray system comprising at least one nozzle or spray head and at least one fluid for spraying the waste container with the fluid;

a loading arm or tipping system for lifting and inverting the waste container over said spray system and setting it back down;

a fluid storage tank for said fluid; and a conveyor system for transporting debris away from the waste container.

2. The mobile waste container cleaning system of claim 1 wherein said loading arm comprises a bendable loading arm for inverting the waste container at an angle of more than 150 degrees over said spray system.

3. The mobile waste container cleaning system of claim 2 wherein said loading arm comprises a 180 degree bendable loading arm for inverting the waste container approximately 180 degrees over said spray system.

4. The mobile waste container cleaning system of claim 1 wherein said loading arm further comprises a knuckle.

5. The mobile waste container cleaning system of claim 1 wherein said fluid spray system further comprises at least one rotatable coupling for a spray head or a spray nozzle.

6. The mobile waste container cleaning system of claim 1 comprising two spray heads.

7. The mobile waste container cleaning system of claim 1 wherein said fluid spray system comprises at least one directional spray nozzle.

8. The mobile waste container cleaning system of claim 1 wherein said fluid spray system further comprises at least one brushing or wiping system.

9. The mobile waste container cleaning system of claim 1 wherein said fluid spray system comprises spraying a mixture of at least one fluid selected from the group consisting of clean fluid, recycled fluids, detergent, degreaser, granules, and chemicals through at least one spray nozzle.

10. The mobile waste container cleaning system of claim 1 wherein said fluid spray system comprises a first layer of nozzles for spraying clean or recycled fluid.

11. The mobile waste container cleaning system of claim 10 wherein said fluid spray system comprises a second layer of nozzles and a detergent system for spraying a detergent.

12. The mobile waste container cleaning system of claim 11 wherein said fluid spray system comprises a third layer of nozzles and a degreaser system for spraying a degreaser.

13. The mobile waste container cleaning system of claim 10 wherein said fluid spray system comprises a second layer of nozzles and a degreaser system for spraying a degreaser.

14. The mobile waste container cleaning system of claim 1 further comprising a fluid recycling system.

15. The mobile waste container cleaning system of claim 1 wherein said mobile waste container cleaning system comprises a modified garbage truck.

16. The mobile waste container cleaning system of claim 15 wherein said modified garbage truck comprises a member selected from the group consisting of a side loading truck, a front loading truck and a rear loading truck.

17. The mobile waste container cleaning system of claim 1 wherein said conveyor system comprises a system selected from the group consisting of a conveyor belt, walking floor, and trumbull system.

18. The mobile waste container cleaning system of claim 1 wherein said loading arm comprises a member selected from the group consisting of a side loading arm, a front loading arm and a rear loading arm.

19. The mobile waste container cleaning system of claim 1 wherein said loading arm is a member selected from the group manual, automated and semi-automated loading arms.

20. The mobile waste container cleaning system of claim 1 wherein said tipping mechanism comprises a member selected from the group consisting of manual, automated and semi-automated tipping mechanisms.

21. The mobile waste container cleaning system of claim 1 wherein said fluid comprises a material selected from the group consisting of cold fluid, hot fluid, steam, chemicals, liquids, solids, semi-solids, gases, chemicals, oils, granules and sprays.

22. The mobile waste container cleaning system of claim 1 wherein said conveyor system comprises guide rails.

23. The mobile waste container cleaning system of claim 1 wherein said conveyor system comprises v-notches.

24. The mobile waste container cleaning system of claim 1 wherein said conveyor system comprises a brush to clean said conveyor system.

25. The mobile waste container cleaning system of claim 1 wherein said conveyor system comprises a slanted conveyor system.

26. The mobile waste container cleaning system of claim 1 further comprising a catch basin.

27. The mobile waste container cleaning system of claim 1 further comprising a debris bin.

28. A method for cleaning a large waste container, the method comprising the steps of:

transporting on a mobile base a waste container cleaning system comprising a spray system comprising at least one nozzle or spray;

lifting and inverting the waste container with a loading arm or tipping system over the spray system;

spraying the waste container with a fluid from the spray system;

removing the waste container from the spray system with the loading arm or tipping system, uprighting the container and setting it back down;

storing the fluid in a storage tank disposed on the mobile base; and transporting debris away from the waste container with a conveyor system disposed on the mobile base.

29. The method of claim 28 wherein the step of lifting and inverting the waste container comprises inverting the waste container at an angle of more than 150 degrees over the spray system.

30. The method of claim 29 wherein the step of lifting and inverting the waste container comprises inverting the waste container approximately 180 degrees over the spray system.

31. The method of claim 28 wherein the step of lifting the waste container comprises lifting with a method selected from the group consisting of side loading, front loading and rear loading.

32. The method of claim 28 wherein the step of lifting the waste container comprises lifting with a member selected from the group of manual, automated and semi-automated loading arms.

33. The method of claim 28 wherein the step of providing a mobile method for cleaning a waste container comprises modifying a garbage truck.

34. The method of claim 33 wherein the step of modifying a garbage truck comprises providing a vehicle selected from the group consisting of a side loading truck, a front loading truck and a rear loading truck.

35. The method of claim 28 wherein the step of conveying the debris away from the waste container comprises providing a system selected from the group consisting of a conveyor belt, walking floor, and trumbull system.

36. The method of claim 28 wherein the step of spraying a fluid comprises spraying with at least one fluid selected from the group consisting of cold fluid, hot fluid, steam, chemical, liquid, solid, semi-solid, gas, oil, and granule.

37. The method of claim 28 further comprising the step of rotating a coupling of the spray system.

38. The method of claim 28 wherein the step of spraying a fluid comprises spraying directionally with a spray nozzle.

39. The method of claim 28 wherein the step of spraying comprises passing a fluid through at least one spray nozzle disposed on at least one spray head disposed on at least one rotatable coupling, and spraying the inverted waste container with the fluid.

40. The method of claim 28 wherein the step of spraying comprises brushing or wiping with a brushing or wiping mechanism.

41. The method of claim 28 wherein the step of spraying comprises recycling the fluid.

42. The method of claim 28 wherein the fluid spray system comprises spraying a mixture of at least one fluid selected from the group consisting of clean fluid, recycled fluids, detergent, degreaser, granules, and chemicals through at least one spray nozzle.

43. The method of claim 28 wherein the step of spraying comprises spraying the waste container with first layer of nozzles using clean or recycled fluid.

44. The method of claim 43 wherein the step of spraying comprises spraying the waste container with a detergent using a second layer of nozzles.

45. The method of claim 44 wherein the step of spraying comprises spraying the waste container with a degreaser using a third layer of nozzles.

46. The method of claim 43 wherein the step of spraying comprises spraying the waste container with a degreaser using a second layer of nozzles.

47. The method of claim 28 wherein the conveyor system comprises guide rails.

48. The method of claim 28 wherein the conveyor system comprises v-notches.

49. The method of claim 28 further comprising the step of cleaning the conveyor system with a brush.

50. The method of claim 28 further comprising the step of slanting the conveyor system.

51. The method of claim 28 further comprising the step of catching debris from the inverted waste container in a catch basin.

52. The method of claim 51 further comprising conveying the debris from the catch basin to a debris bin.

53. The method of claim 28 further comprising manipulating the loading arm or tipping system with a knuckle.

* * * * *

UNITED STATES PATENT AND TRADEMARK OFFICE

CERTIFICATE OF CORRECTION

PATENT NO. : 7,225,816 B2
APPLICATION NO. : 11/212276
DATED : June 5, 2007
INVENTOR(S) : Ernest F. Byers It is certified that error appears in the above-identified patent and that said Letters Patent is hereby corrected as shown below:

Col. 10, Claim 16, line 13, please replace “15” with --1--.

Signed and Sealed this

Seventh Day of August, 2007

JON W. DUDAS
*Director of the United States Patent and Trademark Office*